United States Patent [19]

Hofer

[11] Patent Number: 4,753,211

[45] Date of Patent: Jun. 28, 1988

[54] APPARATUS FOR ADJUSTING THE INJECTION ONSET IN A FUEL INJECTION PUMP

[75] Inventor: Gerald Hofer, Weissach-Flacht, Fed. Rep. of Germany

[73] Assignee: Robert Bosch GmbH, Stuttgart, Fed. Rep. of Germany

[21] Appl. No.: 10,070

[22] Filed: Feb. 2, 1987

[30] Foreign Application Priority Data

Apr. 2, 1986 [DE] Fed. Rep. of Germany ..... 3611044

[51] Int. Cl.[4] ..... F07M 39/00

[52] U.S. Cl. ..... 123/502; 123/179 L; 123/449

[58] Field of Search ..... 123/502, 501, 500, 449, 123/179 L, 458

[56] References Cited

U.S. PATENT DOCUMENTS

| | | | |
|---|---|---|---|
| 2,910,975 | 11/1959 | Evans | 123/502 |
| 3,147,746 | 9/1964 | Hofer | 123/502 |
| 3,486,492 | 12/1969 | Lehnerer | 123/502 |
| 4,079,719 | 3/1978 | Varcoe | 123/502 |
| 4,333,437 | 6/1982 | Lohiver | 123/179 L |
| 4,342,301 | 8/1982 | Tomita | 123/502 |
| 4,354,474 | 10/1982 | Kobayashi | 123/179 L |
| 4,557,240 | 12/1985 | Sakuranaka | 123/179 L |
| 4,593,669 | 6/1986 | Igarashi | 123/502 |
| 4,610,234 | 9/1986 | Sakuranaka | 123/179 L |

FOREIGN PATENT DOCUMENTS

| | | | |
|---|---|---|---|
| 0060830 | 5/1981 | Japan | 123/502 |
| 0128932 | 7/1984 | Japan | 123/502 |

*Primary Examiner*—Carl Stuart Miller

*Attorney, Agent, or Firm*—Edwin E. Greigg

[57] ABSTRACT

An adjusting apparatus for the injection onset of a fuel injection pump includes a spring-loaded adjusting piston which shifts a rotationally adjustable roller ring of a cam drive of an injection pump relatively toward an associated revolving portion in a direction of an early or late injection onset. The adjusting piston defines two control pressure chambers, both of which are acted upon by the supply pressure, of a fuel feed pump which rises as a function of rpm. One chamber can be pressure-relieved via an overpressure valve and the pressure in the other chamber is controlled via a switching valve which is controlled in accordance with temperature. In the control pressure chambers, springs are provided to act upon the adjusting piston and to counteract the pressure in the respective chamber.

5 Claims, 2 Drawing Sheets

APPARATUS FOR ADJUSTING THE INJECTION ONSET IN A FUEL INJECTION PUMP

BACKGROUND OF THE INVENTION

The invention is based on an injection onset adjusting apparatus in a fuel injection pump. The objective of an adjusting apparatus of this kind is to shift the injection onset to earlier at low engine rpm in order to improve starting, but at idling rpm to set a later injection onset and with increasing engine speed again to set an early injection onset. To this end, an adjusting apparatus of this generic type known for example from German Auslegeschrift No. 10 94 527 has in addition to the adjusting piston a coaxial supporting piston having a larger diameter than the adjusting piston, and a compression spring disposed between these pistons. The two ends of the adjusting piston and supporting piston remote from one another can be acted upon by the supply pressure of the fuel feed pump, in the case of the adusting piston via a check valve, and in the case of the support piston via an overpressure valve, so that only beyond a predetermined supply pressure is the support piston acted upon and displaced in the direction of a "late" injection onset, until it comes to a stop on a "late" injection onset, and until it comes to a standstill on a stop attached to the housing. As a result, with increasing rpm and correspondingly increasing supply pressure, the adjusting piston is displaced back toward an "early" injection onset, counter to the action of the compression spring.

OBJECT AND SUMMARY OF THE INVENTION

The adjusting apparatus according to the invention has the advantage over the prior art of occupying little space. Furthermore, the "late" position is influenced at the starting rpm by the temperature course of the engine.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
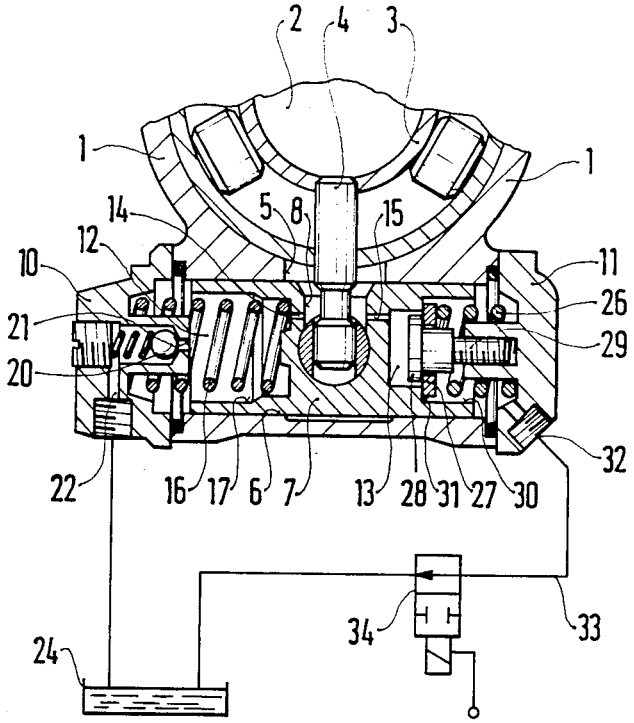
FIG. 1 is a sectional view of a portion of an injection pump having a first exemplary embodiment of an adjusting apparatus.

In the housing 1 of a fuel injection pump, surrounding a suction chamber 2, there is a cam drive, which for example in the case of a distributor injection pump has a rotationally adjustable roller ring 3 or in the case of a radial piston injection pump has a rotationally adjustable cam ring. A pin 4 is inserted radially into the roller ring 3 and extends through an opening 5 in the housing 1 into a recess 8 of an adjusting piston 7 that is displaceable in a cylinder 6. In the axial direction, the cylinder 6 is closed on both ends with respective end caps 10, 11. The adjusting piston 7, which in a known manner serves to turn the roller ring 3 in either direction to adjust the instant of injection onset of the injection pump. The adjusting piston 7 divides the cylinder 6 into left and right control pressure chambers 12 and 13 as seen in the drawing. Throttle bores 14, 15 leading from the ends of the adjusting piston 7 are oriented toward the control pressure chambers 12, 13 and extend to the recess 8 to effect communication of the control pressure chambers 12, 13 with the suction chamber 2. In the left control pressure chamber 12, a helical compression spring 16 is supported on the cap 10 and on the bottom of an axial recess 17 of the adjusting piston 7 which acts counter to the left adjusting piston 7 in the direction of an "early" injection onset, that is, to the left as shown in FIG. 1.

In the left cap 10, there is a pressure maintenance or overpressure valve 20, the inlet 21 of which is oriented toward the left control pressure chamber 12 and the outlet 22 which leads to a pressure-free fuel reservoir 24. The overpressure valve 20 is adjusted such that it does not open until a predetermined pressure has been reached in the control pressure chamber 12 and maintains this pressure in cooperation with the throttle bore 14, through which fuel flows at supply pressure out of the suction chamber 2 into the control pressure chamber 12. A buildup of pressure in the left control pressure chamber 12 effects a displacement of the adjusting piston 7 toward the right, in the direction of a "late" injection onset. In the right-hand control pressure chamber 13, a second helical compression spring 26 is supported on the cap 11 and on a ring 27, which in its normal position is supported on the head of a screw 29 which is threaded into the cap 11 and in this position retains the helical compression spring 26 biased in a captive position. The helicap compression spring 26, the ring 27 and the screw 29 protrude into an axial recess 30 of the adjusting piston 7, which has a shoulder 31 axially coinciding with the radially outer circumference of the ring 27. When the adjusting piston 7 is displaced toward the right, out of the pressure-free position shown, the shoulder 31 comes to rest on the ring 27, compressing the helical compression spring 26. The right-hand control pressure chamber 13 has an outlet 32 on the cap side, which communciates via a line 33 with the fuel reservoir 24. Incorporated into the line 33 is a switching valve 34 in the form of a 2/2-way valve, which in one position is open to connect the control pressure chamber 13 with the fuel reservoir 24 and in the other position is closed to prevent flow of fluid from chamber 13 to the reservoir 24. The switching valve 34 is actuated electromagnetically in accordance with the temperature of the fuel or of the engine, so that at a low temperature it assumes an open position and at a higher temperature it assumes a blocking position.

Figure 2:
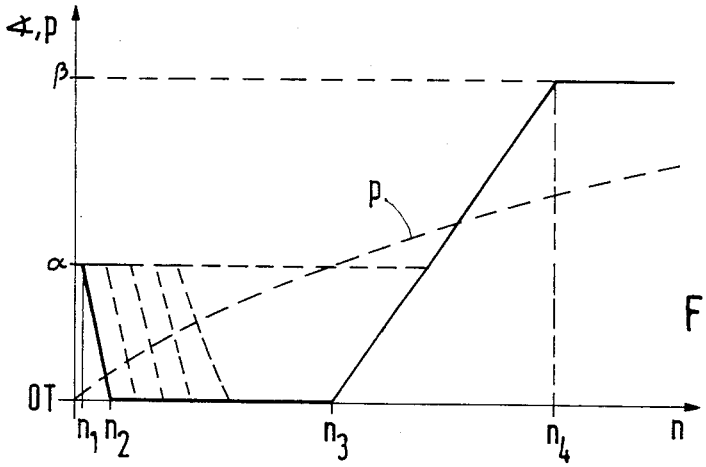
FIG. 2 is a graph showing the adjustment of the injection onset as a function of the engine rpm.

The above-described exemplary embodiment of the adjusting apparatus shown in FIG. 1 functions as follows:

The movable parts of the adjusting apparatus are shown in the position that they assume when the engine is shut off and when it is turned on, at a starting rpm that is below the idling rpm. The roller ring 3 is located in a position in which the injection onset takes place at the angle $\alpha$ (FIG. 2) prior to top dead center OT of the associated engine piston. However, as soon as the engine has been turned on or has attained operating speed, a feed pump not shown in the exemplary embodiment of FIG. 1 but represented as element 35 in the exemplary embodiment of FIG. 3 pumps fuel from the reservoir 24 at a supply pressure p that increases as the rpm increases (see FIG. 2) into the suction chamber 2 of the injection pump. Because of the communication of the two control pressure chambers 12, 13 via the throttle bores 14, 15 and the recess 8 in the adjusting piston 7, the pressure in the two control pressure chambers 12, 13 rises as well. Since during starting at a lower temperature the switching valve 34 is open and so keeps the control pressure chamber 13 pressure-free, then with increasing pressure in the control pressure chamber 12, at an increase in rpm form $n_1$ to $n_2$, the adjusting piston 7 is displaced toward the right, overcoming the force of the spring 26, so that the injection onset at starting is shifted from "early" to "late" at idling rpm. Depending on the force of the spring 26, the shift begins at a lower or higher rpm $n_1$. With this shift, the roller ring 3 is turned and the injection onset is reset to OT. This injection onset setting is maintained until rpm $n_3$, at which rpm the supply pressure p of the feed pump has attained a pressure equivalent to the over pressure of valve 20 which permits fluid to escape from the overflow 20, so that this valve now opens and in copperation with the throttle bore 14 prevents any further buildup of pressure in the control pressure chamber 12. At this time the switching valve 34 has been switched into its blocking or closed position because of the rising engine temperature. The pressure in the right-hand control pressure chamber 13 also rises, so that the adjusting piston 7, with the cooperation of the helical compression spring 26, is returned to the left. As the pressure of the feed pump continues to increase with rising rpm, the pressure in the right-hand control pressure chamber 13 becomes higher than in the left-hand control pressure chamber 12, in which the pressure is limited by the overflow valve 20, so that the adjusting piston 7 is displaced farther to the left until finally the piston 7 comes to rest on the cap 10, whereupon, at an rpm $n_4$, the roller ring is shifted by the angle $\beta$ to "early". With dropping rpm, the injection onset is set back to OT, once the rpm $n_3$ is reached. Since the switching valve 34 is now blocked, with the engine warm, the pressures in the two control pressure chambers 12 and 13 are balanced, and so the stronger spring 26 keeps the adjusting piston 7 in the position shown.

Figure 3:
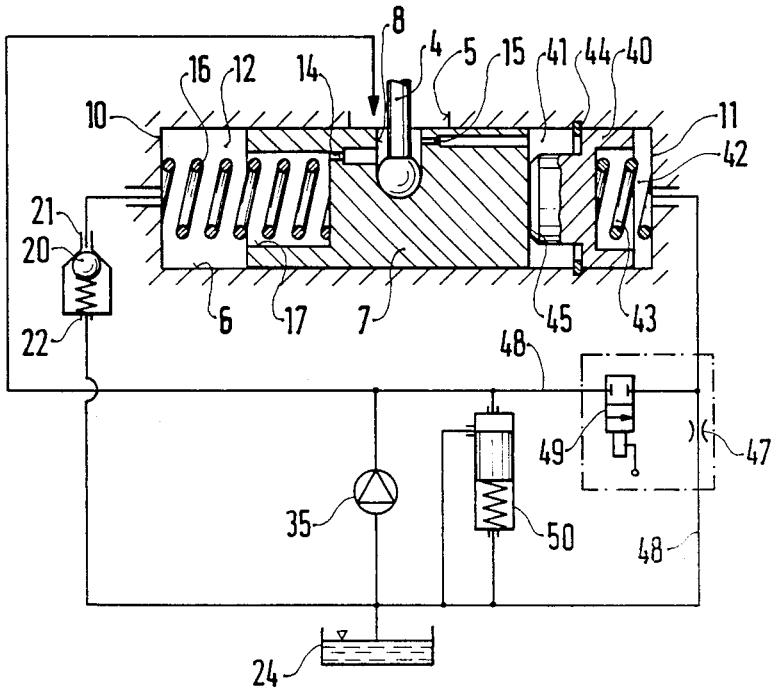
FIG. 3 is a sectional view, in simplified form, of a second exemplary embodiment of an adjusting apparatus.

The exemplary embodiment of FIG. 3 is substantially similar in structure to that of FIG. 1 and is also similar in function, so that identical elements are identified by the same reference numerals. The difference is substantially that in the second exemplary embodiment the right-hand control pressure chamber, in which the pressure for displacing the adjusting piston 7 in the direction of "early" is built up, is divided by a support piston 40 into a left-hand work chamber 41, defined by the adjusting piston 7, and a right-hand work chamber 42 defined by the cap 11. The support piston 40 is positively displaced toward the adjusting piston 7 by a compression spring 43 supported on the cap 11, the displacement path being defined by a snap ring 44, integral with the housing, in the cylinder 6. The support piston 40 has an extension 45 oriented toward the adjusting piston 7, against which extension 45 the helical compression spring 16 in the control pressure chamber 12 presses the adjusting piston 7.

The left-hand work chamber 41 communicates with the suction chamber via the throttle bore 15, so that the pressure in chamber is the same as the rpm-dependent supply pressure in the suction chamber. The right-hand work chamber 42 remote from the adjusting piston 7 communciates via a throttle 47 and a line 48 with the pressure-free reservoir 24. For bulding up a pressure in this work chamber 42, this chamber communicates via a line 48 and a switching valve 49 with the compression side of the feed pump 35, which supplies the left-hand control pressure chamber 12 and the work chamber 41 with fuel at a pressure that rises with increasing rpm. The switching valve 49, as in the exemplary embodiment of FIG. 1, is a 2/2-way valve, which is controlled as a function of the temperature of the engine. At a low temperture the switching valve 49 assumes a blocking position, opening as the temperture rises. The switching valve 49 and the throttle 47 are part of a fuel flow temperature control system.

Parallel to the feed pump 35 is a pressure control valve known per se, with which the pressure in the suction chamber of the injection pump can be varied as a function of the fuel quantity supplied.

The exemplary embodiment of the adjusting apparatus shown in FIG. 3 functions as follows:

The movable parts are shown in the position that they assume at engine shutoff and when the engine is started cold, with a starting rpm below the idling rpm. Upon engine starting and thus by means of the pressure building up by means of the feed pump 35, the same pressure is built up in the control pressure chamber 12 and the work chamber 41, via the throttle bores 14, 15 so that the adjusting piston 7 is balanced in pressure, while contrarily the support piston 40, can deflect to the right, because the right-hand work chamber is relieved of pressure via the throttle 47. In this process, the helical compression spring 16 in the control pressure chamber 12 displaces the adjusting piston 7 toward the right, in the direction of a "late" injection onset. Beyond an rpm at which the supply pressure of the feed pump 35 is equivalent to the relief pressure of the overflow valve 20, the pressure in the work chamber 41 predominates, so that the adjusting piston 7 is displaced to the left, in the direction of "early". The switchover to "early" can also be performed as a function of temperature by the switching valve 49, which with rising temperature assumes an open position and thus connects the work chamber 42 with the compression side of the feed pump 35. At the resultant pressure building up in the work chamber 42 and with the action of the helical compression spring 43, the support piston 40 is displaced toward the adjusting piston 7, thereby shifting the latter toward the left in the direction of "early".

In both the exemplary embodiments described, the switching valve has been described as an electromagnetic valve controlled by a temperature sensor. However, it can also be actuated with a thermal expansion element.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. An adjusting apparatus for the injection onset in a fuel injection pump, having a cam drive generating the pumping strokes which comprises, a pump housing, an adjustable roller ring (3) located in said pump housing (1), said roller ring is adjustable relatively toward an associated revolving portion in order to adjust the injection onset, a closed end cylinder 6, a spring-loaded adjusting piston (7) in said cylinder which defines first and second control pressure chambers (12, 13; 41, 42) a fuel injection pump that supplies an rpm-dependent fuel supply pressure to said control pressure chambers which act upon said piston, a spring (16) which acts counter to an adjustment toward "early", a resilient stop (27; 40) which acts counter to an adjustment toward "late", an overpressure valve 20 associated with said first control pressure chamber (12) to control pressure which is built up for displacing said adjusting piston (7) for adjustment toward "late" counter to the actio of said resilient stop (27; 40), and a temperture-controlled switching valve (34; 49) associated with said second control pressure chamber (13; 42) for pressure buildup or pressure relief in said second pressure chamber (13).

2. An adjusting apparatus as defined by claim 1, in which said resisent stop (27) is disposed in said second control pressure chamber (13), and said switching valve (34) is opened at a relatively low temperature.

3. An adjusting apparatus as defined by claim 2, in which said resilient stop (27) is annular in embodiment and is restrained by a stationary coaxial screw head (28).

4. An adjusting apparatus as defined by claim 1, in which said second control pressure chamber (13) is divided into two chambers (41, 42) by a displaceable support piston (40) embodying said resilient stop, a front chamber (41), defined by said adjusting piston said support piston (7), and is permanently acted upon by the supply presssure, and a rear chamber (42) which is pressure-relieved by said temperature-controlled switching valve (49) at a low temperature and with rising temperature is acted upon by the supply pressure.

5. An adjusting apparatus as defined by claim 4, in which said support piston (40) and said adjusting piston (7) have the same diameter and are displaceable in said cylinder (6).

* * * * *